US007461596B2

(12) United States Patent
Zinell et al.

(10) Patent No.: US 7,461,596 B2
(45) Date of Patent: Dec. 9, 2008

(54) SAFETY AND ARMING UNIT FOR A SPINNING PROJECTILE FUZE

(75) Inventors: Alexander Zinell, Villingen-Schwenningen (DE); Frank Kienzler, VS-Villingen (DE); Martin Leonhardt, Aichhalden (DE); Ronald Ketterer, Lauterbach (DE); Günter Westphal, Hardt (DE)

(73) Assignee: JUNGHANS Microtec GmbH, Dunningen-Seedorf (DE)

( * ) Notice: Subject to any disclaimer, the term of this patent is extended or adjusted under 35 U.S.C. 154(b) by 0 days.

(21) Appl. No.: 11/871,579

(22) Filed: Oct. 12, 2007

(65) Prior Publication Data

US 2008/0173203 A1 Jul. 24, 2008

Related U.S. Application Data

(62) Division of application No. 11/438,824, filed on May 23, 2006, now Pat. No. 7,357,081.

(30) Foreign Application Priority Data

Jun. 24, 2005 (DE) ..... 10 2005 029 326

(51) Int. Cl.
*F42C 15/26* (2006.01)
*F42C 15/22* (2006.01)

(52) U.S. Cl. ..... 102/235; 102/242; 102/245; 102/251; 102/256

(58) Field of Classification Search ..... 102/221, 102/222, 231, 233, 235, 237, 239, 242, 244, 102/245, 251, 256
See application file for complete search history.

(56) References Cited

U.S. PATENT DOCUMENTS

| | | | | |
|---|---|---|---|---|
| 2,455,603 | A | | 12/1948 | Nichols |
| 2,707,918 | A | | 5/1955 | Clay |
| 2,960,037 | A | | 11/1960 | Racch, Jr. et al. |
| 3,397,640 | A | | 8/1968 | Ziemba et al. |
| 3,949,675 | A | * | 4/1976 | Luke ..... 102/236 |
| 4,004,521 | A | | 1/1977 | Andrejkovics |

(Continued)

FOREIGN PATENT DOCUMENTS

EP 0 360 187 B1 9/1989

(Continued)

*Primary Examiner*—James S Bergin
(74) *Attorney, Agent, or Firm*—Scully, Scott, Murphy & Presser, P.C.

(57) ABSTRACT

A safety and arming unit (10) for a spinning projectile fuze, which has a fuze body (12) and a bearing body (14), which define a spherical cavity (16) between them, in which a spherical rotor (18) is mounted such that it can rotate, in which rotor (18) a detonator (20) is provided. In order to make the safety and arming unit suitable for fuzes in weapon systems with extremely fast munition feed units, the rotor (18) can be surrounded by a rotor locking ring (28) in the safe position, prevents the rotor (18) from rotating through an acceleration ring (30) and a spring element (32) which connects the acceleration ring (30) to the rotor locking ring (28) in an interlocking manner, with the rotor locking ring (28) being formed with a slot (36) in order that it can be spread open by rotation and centrifugal forces into an open space (34).

7 Claims, 3 Drawing Sheets

U.S. PATENT DOCUMENTS

| | | | | |
|---|---|---|---|---|
| 4,213,395 | A | 7/1980 | Breed | |
| 4,242,963 | A | 1/1981 | Ziemba | |
| 4,982,663 | A | 1/1991 | Scheve et al. | |
| 4,995,317 | A | 2/1991 | Bankel et al. | |
| 5,243,912 | A | 9/1993 | Ziemba | |
| 6,389,976 | B1 * | 5/2002 | Zacharin | 102/259 |
| 7,357,081 | B2 * | 4/2008 | Zinell et al. | 102/245 |

FOREIGN PATENT DOCUMENTS

| | | |
|---|---|---|
| EP | 0 724 132 A1 | 7/1996 |
| GB | 1 224 192 | 3/1971 |

* cited by examiner

SAFETY AND ARMING UNIT FOR A SPINNING PROJECTILE FUZE

CROSS REFERENCE TO RELATED APPLICATION

This application is a divisional application of U.S. Ser. No. 11/458,824; filed on May 23, 2006 now U.S. Pat. No. 7,357,081.

BACKGROUND OF THE INVENTION

1. Field of the Invention

The invention relates to a safety and arming unit for a spinning projectile fuze, including a fuze body and a bearing body, which define a spherical cavity therebetween. A spherical rotor in the spherical cavity is rotatably mounted and has a detonator arranged therein.

By way of example, bolt systems with centrifugal-force bolts and a stop are known as safety and arming units for spinning projectile fuze.

2. Discussion of the Prior Art

By way of example, a safety and arming unit for a spinning projectile fuze is described in EP 0 360 187 B1. In this known safety and arming unit, a holding ring is formed with a grooved wedge profile, which has supporting flaps which are oriented radially inwards, and has recesses between them. The supporting flaps and the recesses have base area dimensions of approximately the same size. This affects the behaviour of the holding ring as it is spread open by spinning, that is to say centrifugal forces. This known safety and arming unit also has a spring device, which is formed by a conical spiral compression spring.

SUMMARY OF THE INVENTION

The invention is based on the object of providing a safety and arming unit of the type mentioned initially for a spinning projectile fuze, in particular for a medium-calibre weapon system, which is suitable for relatively high ramming and feed accelerations.

The safety and arming unit according to the invention has the advantage that the rotor for the fuze which is provided in the fuze body is released only when the firing acceleration and the spin-dependent rotation acceleration are present. This means that brief impulses, such as those which occur in the case of a drop test, are not detected as a signal which is sufficient for initiation, so that the rotor remains in the safe position. In particular, the safety and arming unit according to the invention advantageously absorbs extremely high feed and ramming accelerations, and does not transmit via the rotor to the internal structure. This advantageously leads to high functional reliability.

BRIEF DESCRIPTION OF THE DRAWINGS

Further details, features and advantages will become evident from the following description of two exemplary embodiments, which are illustrated in the drawing, of the safety and arming unit according to the invention, wherein.

DETAILED DESCRIPTION OF THE INVENTION

Figure 1:
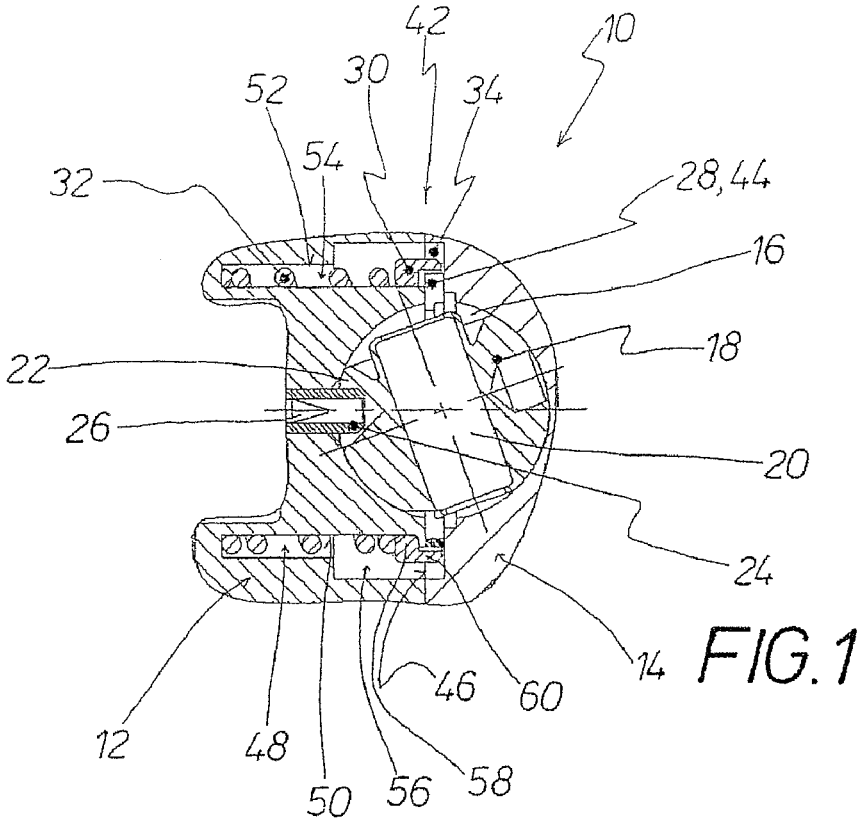
FIG. 1 shows a longitudinal section illustration of a part of a first embodiment of the safety and arming unit, in the safe position.
Figure 3:
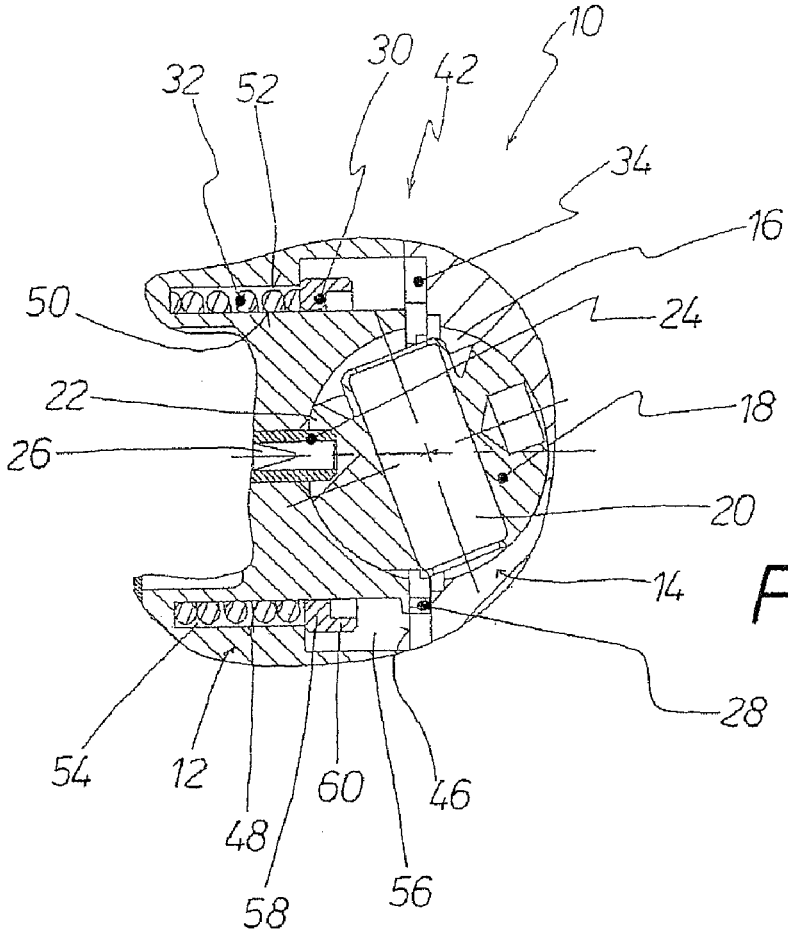
FIG. 3 shows a longitudinal sectional illustration, similar to that in FIG. 1, of the safety and arming unit in the armed position.

FIG. 1 shows a detail in the form of a longitudinal section of one embodiment of the safety and arming unit 10 for a spinning projectile fuze. The safety and arming unit 10 has a fuze body 12, part of which is shown, and a bearing body 14, only part of which is likewise shown. The fuze body 12 and the bearing body 14 each have a hemispherical cavity, so that a spherical cavity 16 is formed between the fuze body 12 and the bearing body 14 in the mated state. A spherical rotor 18 is mounted in the spherical cavity 16 such that it can rotate. A detonator 20 is arranged in the spherical rotor 18. The spherical rotor 18 also has a recess 22 into which a bush 24 projects in an interlocking manner in the safe position as shown in FIG. 1—and also in the armed position as shown in FIG. 3—and the bush is connected to a second arming system (which is not shown). A striking needle 26 is arranged in the bush 24, in order to strike the detonator 20, after the rotor 18 has been moved to the axial armed position.

The spherical rotor 18 is surrounded by a rotor locking ring 28 which, when in the safe position (see FIG. 1), prevents the rotor 18 from being rotated to the armed position by means of an acceleration ring 30 and a spring element 32, which connects the acceleration ring 30 to the rotor locking ring 28 in an interlocking manner. The rotor locking ring 28 is formed with a slot 36 (see FIG. 2) so that rotation and centrifugal forces spread it open into a free space 34. In order to make it easier for the rotor locking ring 28 to be spread open by rotation and centrifugal forces into the free space 34, the rotor locking ring 28 has a notch 38 diametrically opposite the slot 36. This notch 38 produces a corresponding material weakening 40 in the rotor locking ring 28, thus making it easier for the rotor locking ring 28 to spread open as mentioned.

As can also be seen in FIG. 1, the rotor locking ring 28 is provided such that it can be spread open by rotation and centrifugal forces in the equatorial connecting area 42 between the fuze body 12 and the bearing body 14. The rotor locking ring 28 is arranged in a recess 44, which is formed on the end face 46, adjacent to the fuze body 12, of the bearing body 14. The recess 44 has the free space 34 for the rotor locking ring 28, which is spread open by rotation and centrifugal forces.

The fuze body 12 has an annular, axially oriented holding area 48 for the spring element 32 and the acceleration ring 30. The acceleration ring 30 is guided such that it can move axially along an axially oriented cylindrical guide surface 50 which bounds the holding area 48 on the inside. On the outside, the holding area 48 has a stepped profile 52. The stepped profile 52 results in a bearing section 54 on the inside for the spring element 32 and a guide section 56, which is axially adjacent to it on the outside, for the acceleration ring 30. The acceleration ring 30 has an L-shaped cross-sectional profile with a contact limb 58 for the spring element 32, and a holding limb 60 for the rotor locking ring 28.

The method of operation of the safety and arming unit 10 will be explained in the following text with reference to FIGS. 1 to 4, in which identical details are in each case annotated with the same reference numbers, so that there is no need in each case to describe all of the details in detail in conjunction with FIGS. 1 to 4.

Figure 2:
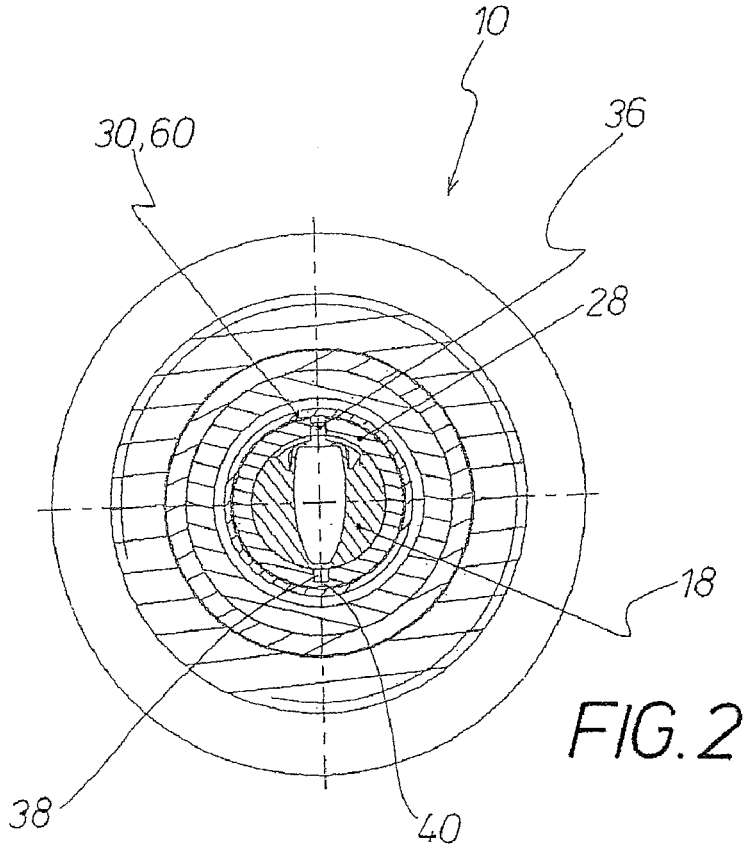
FIG. 2 shows a cross section through the safety and arming unit as shown in FIG. 1, in the safe position.

In the safe position as shown in FIGS. 1 and 2, the rotor locking ring 28 fixes the spherical rotor 18. The acceleration ring 30 prevents the rotor locking ring 28 from being able to open. The spring element 32 is forced against the acceleration ring 30, so that it holds the acceleration ring 30 in the safe position.

If a brief acceleration occurs, for example on carrying out a drop test, the acceleration ring 30 can compress the spring element 32. In the process, the interlock between the acceleration ring 30 and the rotor locking ring 28 is overcome, and the rotor locking ring 28 is released. However, this release does not result in the rotor locking ring opening, that is to say in it spreading open, because no rotation takes place. The rotor 18 therefore cannot rotate to the axial armed position.

Once the stated brief translational acceleration has decayed, the acceleration ring 30 is moved back to the safe position, as shown in FIGS. 1 and 2, by the removal of the load from the spring element 32.

FIG. 2 illustrates the rotationally symmetrical design of the safety and arming unit and, in particular, the design of the rotor locking ring 28 with the slot 36 and the notch 38, and the material weakening 40 produced by the notch 38.

Figure 4:
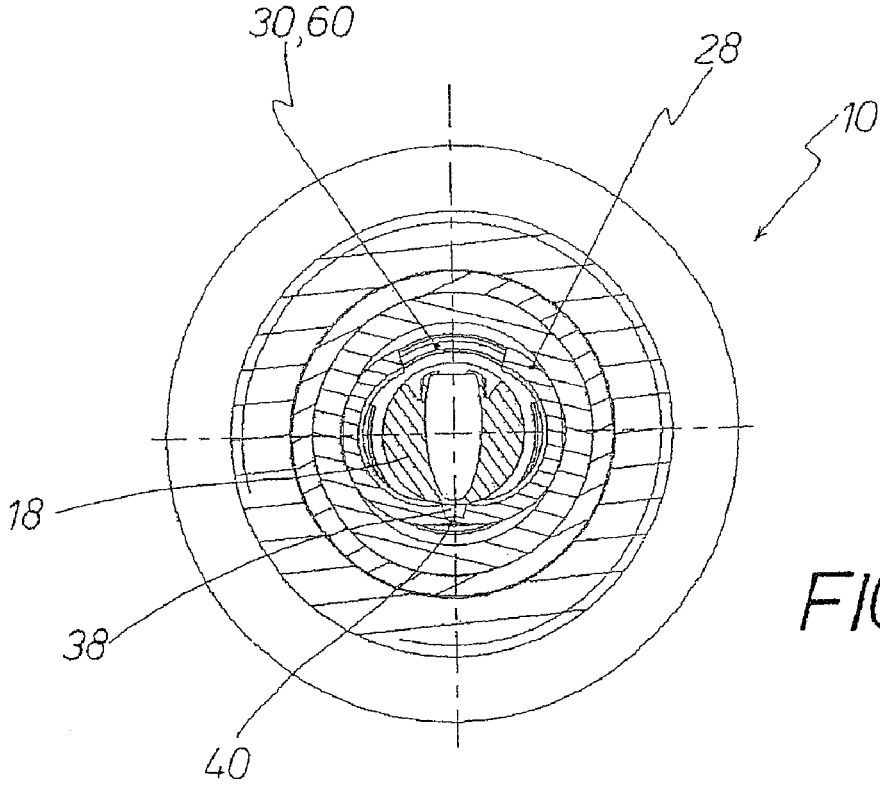
FIG. 4 shows a cross section through the armed safety and arming unit.

FIGS. 3 and 4 show the safety and arming unit 10 in the armed position. In this case, the released spring element 32 is compressed by the acceleration ring 30 during the continuous firing acceleration. When the spin-dependent rotation, and the centrifugal force resulting from it, occurs, the rotor locking ring 28 is moved radially outwards into the free space 34, as is clearly shown in FIG. 4, and the rotor 18 is released.

When the firing acceleration decreases, the load on the spring element 32 is removed again, and the acceleration ring 30 moves back in the direction of the safe position. However, the acceleration ring 30 cannot move back again to the safe position as shown in FIG. 1 because it is now blocked by the spread-open rotor locking ring 28, that is to say its holding limb 60 comes into contact with the spread-open rotor locking ring 28. The spring element 32 thus stresses the rotor locking ring 28 in its position, via the acceleration ring 30. However, the rotor 18 cannot rotate to its axial armed position until the bush 24 is released by a second arming system (which is not shown), and is moved away from the rotor 18.

FIG. 4 shows the deformed, that is to say spread-open rotor locking ring 28, which is opened by centrifugal forces when rapid rotation occurs, and releases the rotor 18.

Figure 5:
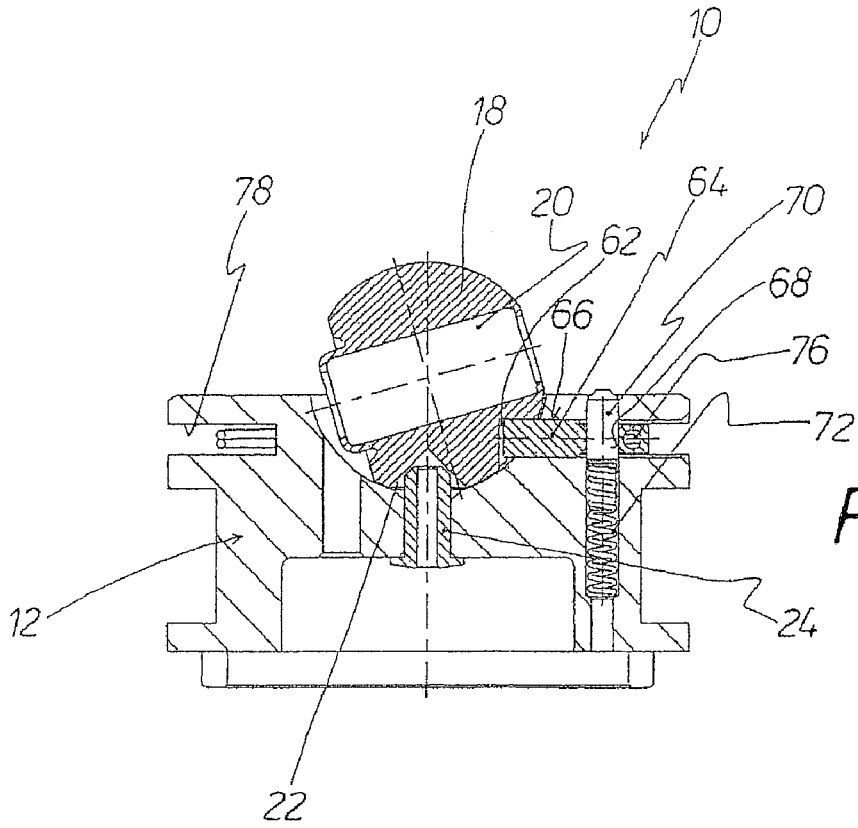
FIG. 5 shows a longitudinal sectional illustration of a second embodiment of the safety and arming unit, illustrating only the fuze body, but not the bearing body for the safety and arming unit as well.
Figure 6:
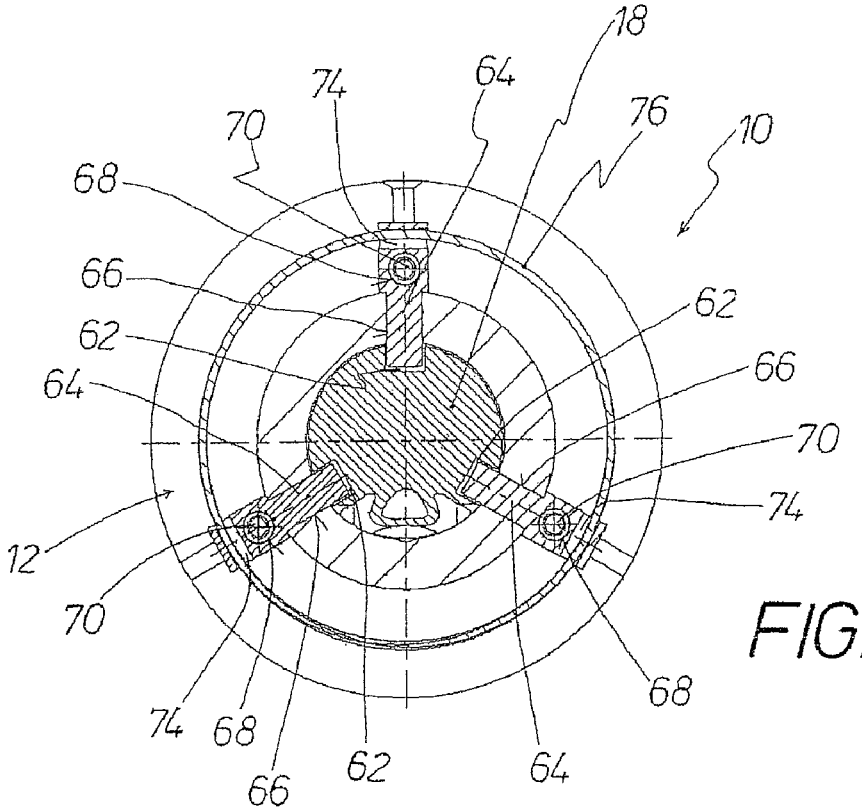
FIG. 6 shows a cross section through the safety and arming unit as shown in FIG. 5.

FIGS. 5 and 6 show a second embodiment of the safety and arming unit 10, although the bearing body 14 is not illustrated. The illustrations show only the cylinder body 12 with its hemispherical cutout.

The spherical rotor in which a detonator 20 is arranged is also annotated with the reference number 18 in FIGS. 5 and 6.

As can be seen from FIG. 6, the rotor 18 has three recesses 62, which are distributed uniformly in the circumferential direction and are oriented radially. In the safe position as shown in FIGS. 5 and 6, an associated radially oriented transverse bolt 64 projects into the respective recess 62. The respective transverse bolt 64 is guided, such that it can move linearly, in an associated transverse bolt guide hole 66 which is formed in the fuze body 12.

At its end section facing away from the rotor 18, each transverse bolt 64 is shown with an axially oriented through-hole, which is intended to hold an axially oriented acceleration bolt 70. A spring element 72 (see FIG. 5) is connected to the respective acceleration bolt 70.

The transverse bolt 64 also each have a through-hole 74 on their radially outer end section. A second spring element 76, which is in the form of a circular spring, extends through the through-holes 74 in the radially oriented transverse bolts 64. The second spring element 76 is formed in an annular groove 78 of the fuze body 12.

The recess which is formed in the rotor 18 and into which a bush 24 projects when the safety and arming unit 10 is in the safe position is also annotated with the reference number 22 in FIG. 5.

The safety and arming unit 10 as shown in FIGS. 5 and 6 operates as follows:

In this embodiment of the safety and arming unit 10, at least one transverse bolt 64 is provided, or, for example, three transverse bolts 64 are provided—depending on the mechanical loads to be expected—in order to be suitable for extremely high feed and ramming accelerations.

When the safety and arming unit 10 is in the safe position, the respective spring element 72 holds the associated axially oriented acceleration bolt in the associated acceleration bolt guide hole 68, so that the respective transverse bolt 64 is fixed, projecting in an interlocking manner into the rotor 18. When a brief acceleration occurs, such as that which occurs during a drop test, the respective acceleration bolt 70 can compress the associated spring element 72. However, the transverse bolts 64 remain in the interlocked safe position with the rotor 18, because the second spring element 76 holds the transverse bolts 64 in the safe position.

FIG. 6 illustrates the rotationally symmetrical design of the safety and arming unit 10.

When a firing acceleration occurs, the acceleration bolts 70 compress the associated spring elements 72, so that the radially oriented transverse bolts 64 are released from the acceleration bolts 70. During the subsequent rotation, the radially oriented transverse bolts 64 are moved outwards by centrifugal force. During this process, the transverse bolts 64 push the second spring element 76 radially outwards, so that the second spring element 76 is moved out. The rotor 18 is thus released.

The radially oriented transverse bolts 64 are moved outwards in the annular groove 78 and can then make contact with an outer housing, which is not illustrated. In this case, the transverse bolts 64 are still guided at all times, so that they can move back to their original position. However, the rotor 18 cannot rotate to the axial position, that is to say to the armed position of the safety and arming unit 10, until the bush 24 is released via a second arming system, which is not illustrated, and is moved away from the rotor 18.

LIST OF REFERENCE NUMBERS

| | |
|---|---|
| 10 | Safety and arming unit |
| 12 | Fuze body (of 10) |
| 14 | Bearing body (of 10) |
| 16 | Spherical cavity (between 12 and 14) |
| 18 | Spherical rotor (at 16) |
| 20 | Detonator (in 18) |
| 22 | Recess (in 18 for 24) |
| 24 | Bush (for 26) |
| 26 | Striking needle (in 24) |
| 28 | Rotor locking ring (for 18 in 34) |
| 30 | Acceleration ring (for 28) |
| 32 | Spring element (for 30) |

-continued

| | |
|---|---|
| 34 | Free space (for 28) |
| 36 | Slot (in 28) |
| 38 | Notch (in 28) |
| 40 | Material weakening (for 38) |
| 42 | Equatorial connecting area (between 12 and 14) |
| 44 | Recess (in 14 for 28) |
| 46 | End face (of 14) |
| 48 | Holding area (for 32) |
| 50 | Cylindrical guide surface (of 48 for 30) |
| 52 | Stepped profile (of 48) |
| 54 | Bearing section (of 48 for 32) |
| 56 | Guide section (of 48 for 30) |
| 58 | Contact limb (of 30 for 32) |
| 60 | Holding limb (of 30 for 28) |
| 62 | Recess (in 18 for 64) |
| 64 | Transverse bolt (of 10) |
| 66 | Transverse bolt guide hole (in 14 for 64) |
| 68 | Acceleration bolt guide hole (in 64 for 70) |
| 70 | Acceleration bolt (of 10) |
| 72 | Spring element (for 70) |
| 74 | Through-hole (in 64) |
| 76 | Second spring element (in 74 for 64) |
| 78 | Annular groove (for 76) |

What is claimed is:

1. A safety and arming unit for a spinning projectile fuze, said fuze including a fuze body (12) and a bearing body which define a hemi-spherical contact therebetween, a spherical rotor (18) being rotatably mounted in said cutout, a detonator (20) being arranged in said rotor (18), said rotor (18) possessing a recess (22) into which a bushing (24) projects in the safe position of the safety and arming unit (10) prevents the rotor (18) from rotating, the rotor (18) having at least one recess (62) into which a radially oriented transverse bolt (64) projects in an interlocking manner in the safe position of the safety and arming unit, at least one transverse bolt (64) being held in the recess (62) in the safe position by an acceleration bolt (70) and a first spring element (72), which are axially oriented, and a second spring element (76) being connected to the at least one transverse bolt (64), said rotor (18) being prevented from rotation into an axial armed position thereof until release of said bushing (24) into movement away from said rotor (18) by a second arming system.

2. A safety and arming unit according to claim 1, wherein the at least one transverse bolt (64) is guided for radial movement in a transverse bolt guide hole (68) which is formed in the fuze body (12).

3. A safety and arming unit according to claim 1, wherein the acceleration bolt (70) which is associated with the at least one transverse bolt (64) is guided for axial movement in an acceleration bolt guide hole (68) which is formed in the fuze body (12).

4. A safety and arming unit according to claim 3, wherein the first spring element (72) which is connected to at least one acceleration bolt (70) is arranged in the acceleration bolt guide hole (68).

5. A safety and arming unit according to claim 1, wherein the first spring element (72) is a cylindrical helical compression spring.

6. A safety and arming unit according to claim 1, wherein the second spring element (76) is a circular spring.

7. A safety and arming unit according to claim 1, wherein the rotor (18) possesses a number of recesses (62) distributed uniformly in a circumferential direction thereof, and an associated transverse bolt (64) projects into each said recess (62).

* * * * *